US009289019B2

(12) United States Patent
Cross

(10) Patent No.: US 9,289,019 B2
(45) **Date of Patent: *Mar. 22, 2016**

(54) ADHESIVE PROTECTIVE COVERING

(71) Applicant: Adam Paul Cross, Lafayette, LA (US)

(72) Inventor: Adam Paul Cross, Lafayette, LA (US)

( * ) Notice: Subject to any disclaimer, the term of this patent is extended or adjusted under 35 U.S.C. 154(b) by 40 days.

This patent is subject to a terminal disclaimer.

(21) Appl. No.: 14/223,597

(22) Filed: Mar. 24, 2014

(65) Prior Publication Data

US 2014/0202037 A1 Jul. 24, 2014

Related U.S. Application Data

(63) Continuation-in-part of application No. 12/804,964, filed on Aug. 3, 2010, now Pat. No. 8,677,651.

(51) Int. Cl.
*A43B 3/12* (2006.01)
*A41D 13/06* (2006.01)
*A41B 11/10* (2006.01)

(52) U.S. Cl.
CPC ..... *A41D 13/06* (2013.01); *A41B 11/10* (2013.01); *A43B 3/12* (2013.01)

(58) Field of Classification Search
CPC ..... A43B 3/12; A43B 13/36
USPC ..... 36/11.5, 15
See application file for complete search history.

(56) References Cited

U.S. PATENT DOCUMENTS

| | | | | |
|---|---|---|---|---|
| 2,985,970 | A * | 5/1961 | McCarthy | 36/11.5 |
| 3,693,269 | A * | 9/1972 | Guarrera | 36/15 |
| 3,903,620 | A * | 9/1975 | Gillet | 36/25 R |
| 5,771,605 | A * | 6/1998 | Safdie | 36/25 R |
| 5,983,527 | A * | 11/1999 | Strickland et al. | 36/12 |
| 6,640,465 | B1 * | 11/2003 | Burgess | 36/15 |
| 7,377,054 | B2 * | 5/2008 | Milner et al. | 36/15 |
| 8,677,651 | B2 * | 3/2014 | Cross | 36/11.5 |
| 2005/0011084 | A1 * | 1/2005 | Stephenson | 36/15 |
| 2006/0037214 | A1 * | 2/2006 | Goggin-Lewis | 36/11.5 |
| 2006/0112591 | A1 * | 6/2006 | Lombardo | 36/7.5 |
| 2008/0098617 | A1 * | 5/2008 | Garrett | 36/11.5 |
| 2010/0037485 | A1 * | 2/2010 | Wu | 36/91 |

* cited by examiner

*Primary Examiner* — Marie Bays
(74) *Attorney, Agent, or Firm* — Ted M. Anthony

(57) ABSTRACT

A protective covering can be quickly and efficiently applied to the skin including, without limitation, the underside of a foot. A sheet of durable material has a first side surface coated with at least one adhesive, and a second (opposite) side surface which can include a traction promoting material or tread design. The durable material can be pre-cut using cross-hatched pattern(s) of intersecting elongate cuts that divide the durable sheet material into segments or pieces. The durable sheet material can be sandwiched between two opposing and removable release liner sheets.

20 Claims, 9 Drawing Sheets

ADHESIVE PROTECTIVE COVERING

CROSS REFERENCE TO RELATED APPLICATION

This application is a continuation-in-part of application Ser. No. 12/804,964, filed Aug. 3, 2010, currently pending, incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

People are frequently injured from various hazards associated with outdoor activities and/or recreational pursuits. Many of these injuries involve injuries to the feet. Such foot injuries are particularly prevalent during water activities.

Although conventional water shoes offer some protection against puncturing and slipping, such conventional water shoes also create other problems, particularly when wet, sandy, and/or muddy. In most cases, such conventional water shoes cause more problems and discomfort than they help to eliminate. As a result, many participants of water-related activities frequently remove their footwear before engaging in such activities and/or getting their feet wet.

In addition to water shoes, individuals participating in outdoor sports and/or water-related activities commonly wear flip-flops and/or sandals for foot protection. For example, such footwear is frequently worn around pools and beaches. However, both types of footwear must be removed before getting wet; most flip-flops and sandals become so slippery if they get wet that it is difficult to walk or even stand without falling.

Thus, there is a need for a protective covering that can be quickly, efficiently and temporarily applied to a user's skin including, without limitation, the underside of a user's foot. The protective covering should provide improved traction, thermal insulation and protection against abrasion or other damage to said skin resulting from physical contact with the surrounding environment, all while reducing or eliminating limitations observed with conventional footwear.

BRIEF SUMMARY OF INVENTION

The present invention comprises a protective covering that can be quickly and efficiently applied to the skin. Although the protective covering of the present invention can be used on virtually any portion of the body, in a preferred embodiment said protective covering can be beneficially applied to the underside of a foot. The protective covering of the present invention provides improved traction, thermal insulation and protection against abrasion or other damage to said skin resulting from physical contact with the surrounding environment (including, without limitation, hot sand, and paved surfaces).

In a preferred embodiment, the present invention comprises a sheet of durable material having desired properties and characteristics. Although other materials can be envisioned without departing from the scope of the present invention, said durable material can comprise woven fabric, plastic, latex or synthetic material, and/or combinations thereof, that is sufficiently durable to provide a protective covering over the skin, while remaining substantially flexible and resilient.

A first side surface of said sheet of durable material can be coated with at least one adhesive material such as, for example, a pressure sensitive adhesive material. When contact is made with skin, said adhesive material should be beneficially capable of adhering to skin, while resisting detachment resulting from contact with underlying support surfaces or the surrounding environment. Said adhesive material should be water-proof or water-resistant, non-allergenic, and should permit selective removal of said durable material from skin when desired without significant damage to or irritation of said skin.

A second opposite side surface of said durable material can be coated with a traction promoting material or tread design. By way of illustration, but not limitation, said second side surface can be coated with a grit material to increase frictional forces when in contact with the ground, a boat deck, or other underlying support surface. In a preferred embodiment said opposite side can also be coated with an adhesive material, although the adherence strength of said second side surface should be less than that of the first side surface.

Said durable sheet material can be beneficially pre-cut using cross-hatched pattern(s) of intersecting elongate cuts that divide said durable sheet material into a plurality of segments or pieces. Although virtually any pattern can be employed, in a preferred embodiment said pattern is beneficially formed to match a specific body part or surface upon which application of said durable sheet material is intended. For example, said durable sheet material can be pre-cut using cross-hatched patterns that approximate shape of and/or conform to the underside of a human foot.

Said durable sheet material is disposed between two opposing release liner sheets. In a preferred embodiment, said release liner sheets each comprise a paper or plastic based substrate that is coated on one or two sides with at least one release agent. Said release liners provide protective packaging of said durable sheet material during storage, transportation or handling by, among other things, preventing inadvertent or unwanted contact between said durable sheet material and other objects. Said release agent(s) can comprise crosslinkable silicone and/or other materials having a beneficially low surface energy that provide a desired release effect against sticky materials, such as the adhesives of said durable sheet material.

As just one advantage, the protective covering of the present invention solves problems associated with the use of conventional footwear in and around sand, mud, and water by providing a durable protective layer adhesively bonded to the bottom of a foot in such a way that no other means of support or attachment are necessary in order to keep said protective covering in place. The protective coating forms a barrier between the foot and the surrounding environment, keeping water, sand, and mud separated from that portion of the foot coated by said protective covering. The protective covering of the present invention eliminates chafing encountered with conventional footwear because the foot and footwear do not rub against each other. Moreover, the protective coating of the present invention feels more natural because it does not inhibit a foot's natural movements or abilities, but still protects said foot from becoming worn and blistered.

In a preferred embodiment, the protective covering of the present invention only adheres to the parts of a foot that need protection (typically those parts of the foot that actually contact the ground or other support surface). Pre-cut shapes also make the protective covering of the present invention capable of fitting many different sizes of feet. Such pre-cut shapes also minimize the amount of material actually bonded to a foot, and makes the protective covering capable of being worn comfortably in sand, water, mud and/or other surroundings without creating a nuisance.

DESCRIPTION OF VIEWS

DETAILED DESCRIPTION OF THE INVENTION

Figure 1:
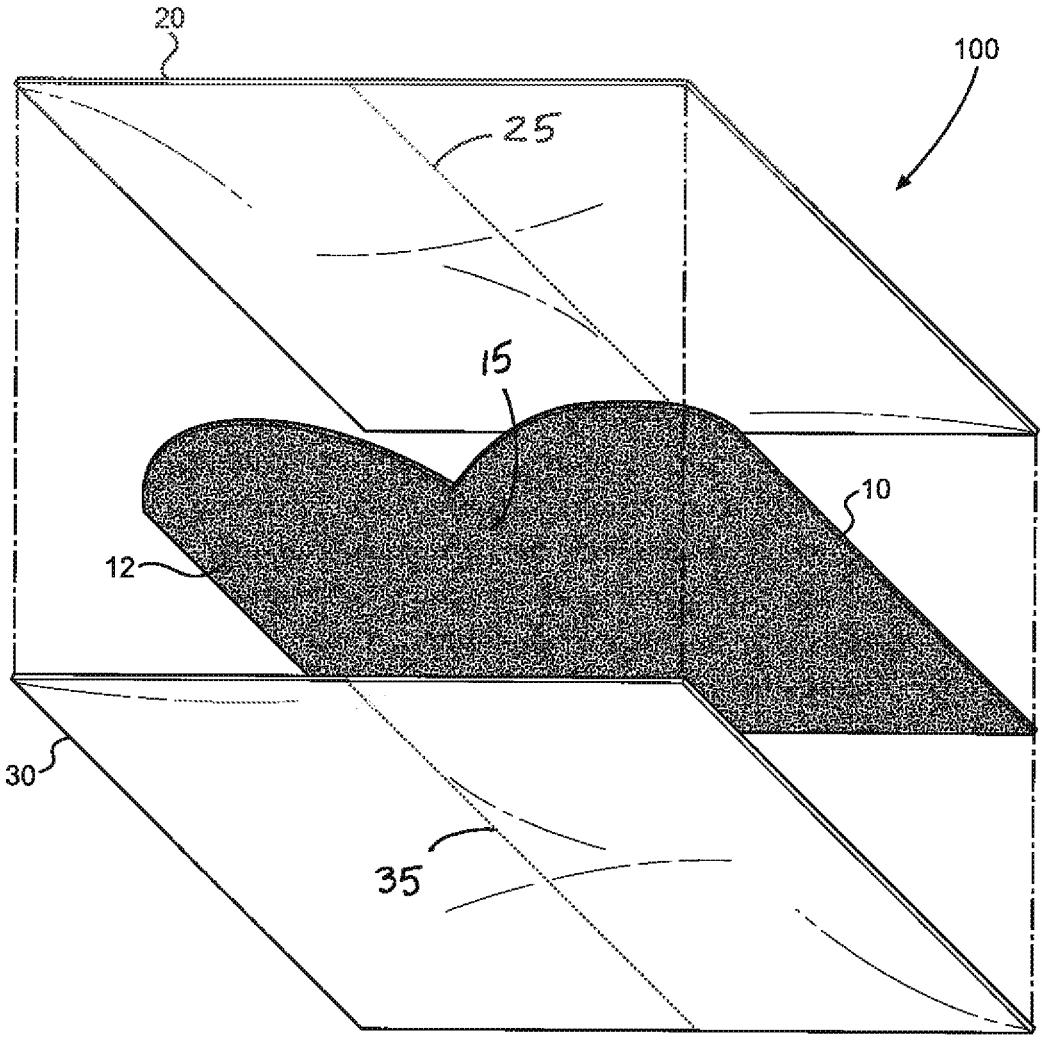
FIG. 1 depicts an exploded perspective view of the protective covering of the present invention.

FIG. 1 depicts an exploded perspective view of protective covering 100 of the present invention. In a preferred embodiment, said protective covering 100 comprises a substantially planar sheet of durable material 10 sandwiched between release liners 20 and 30. Although various configurations can be used, said durable material 10 can be centrally perforated along line 15, while release liners 20 and 30 can be perforated along lines 25 and 35, respectively.

Durable material 10 should exhibit properties and characteristics beneficially tailored and satisfactory for its anticipated uses. Although other materials can be envisioned without departing from the scope of the present invention, said durable material 10 can comprise woven fabric, plastic, latex or synthetic material, and/or combinations thereof, which are durable enough to provide a protective covering over a wearer's skin, while remaining substantially flexible and resilient.

Figure 2:
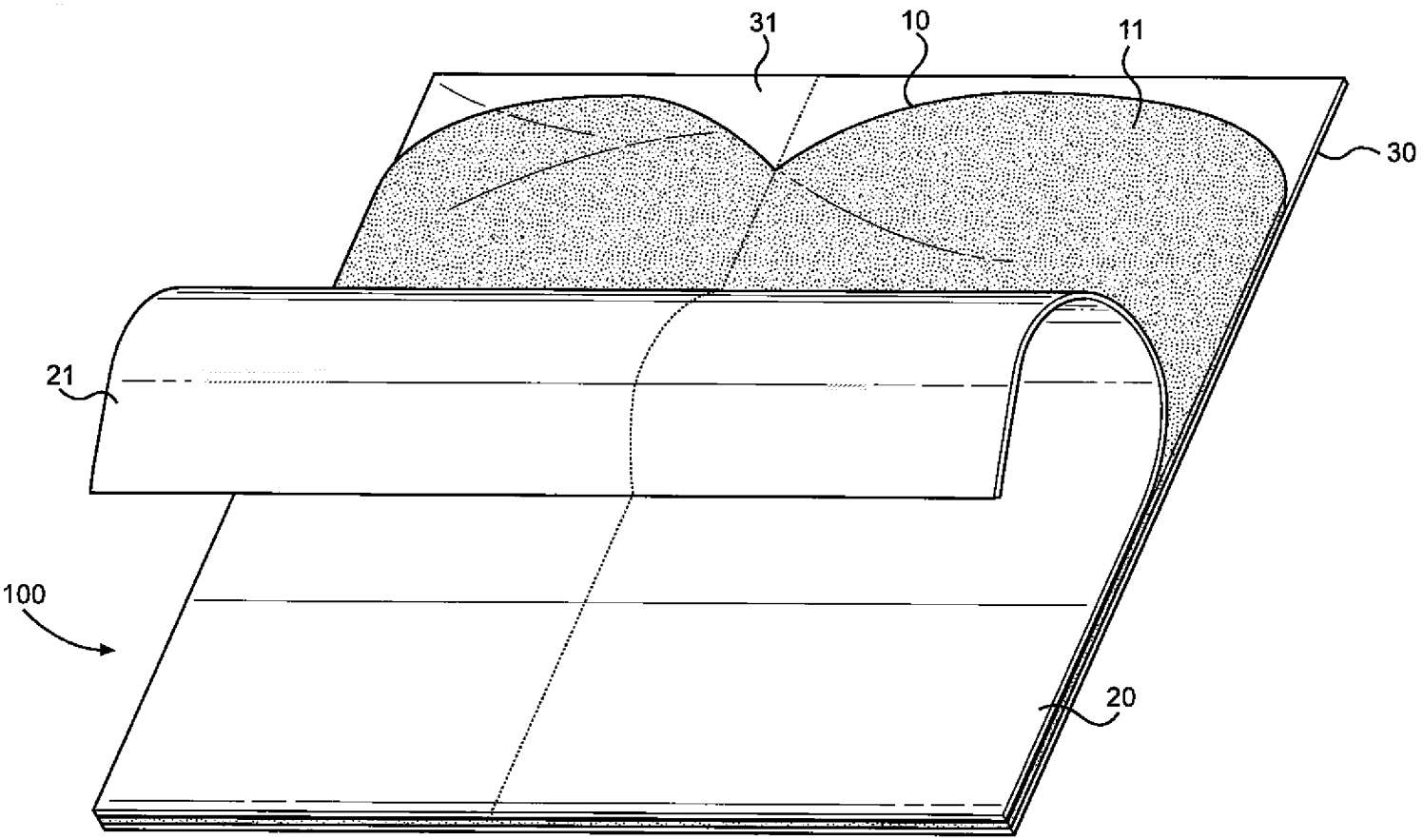
FIG. 2 depicts a top view of the protective covering of the present invention.

FIG. 2 depicts a top view of durable material 10 generally disposed between release liners 20 and 30. A first side surface 11 of said durable material 10 can be coated with at least one adhesive material, which is typically a pressure-sensitive adhesive. Referring to back to FIG. 1, a second side surface 12 of said durable material (that is, the opposite side of sheet 10 from side 11) can be covered with or otherwise comprise a traction promoting material or tread design. By way of illustration, but not limitation, said second side surface 12 can be coated with a grit material to increase frictional forces when in contact with the ground, a boat deck, or other underlying support surface. Referring back to FIG. 2, in a preferred embodiment said side surface 12 can also be coated with an adhesive material, although the adherence strength of said second side surface 12 should be less than that of the adhesive of first side surface 11.

Said durable sheet material 10 is disposed between opposing release liner sheets 20 and 30. In a preferred embodiment, said release liner sheets 20 and 30 each comprise a paper or plastic based substrate coated on one or two sides—including the side surfaces of said release liners that contact sheet material 10—with at least one release agent. Referring to FIG. 2, release liner 20 (depicted as being partially peeled away from surface 11 of durable material 10) is coated on at least a portion of surface 21 with at least one release agent. Similarly, release liner 30 is coated on at least a portion of surface 31 with at least one release agent.

As noted above, release liners 20 and 30 provide protective packaging of durable sheet material 10 during storage, transportation and/or handling thereof. Said release agent(s) can comprise crosslinkable silicone and/or other materials having a beneficially low surface energy that provide a desired release effect against sticky materials, such as the adhesives on sides 11 and 12 of of said durable sheet material 10.

Figure 3:
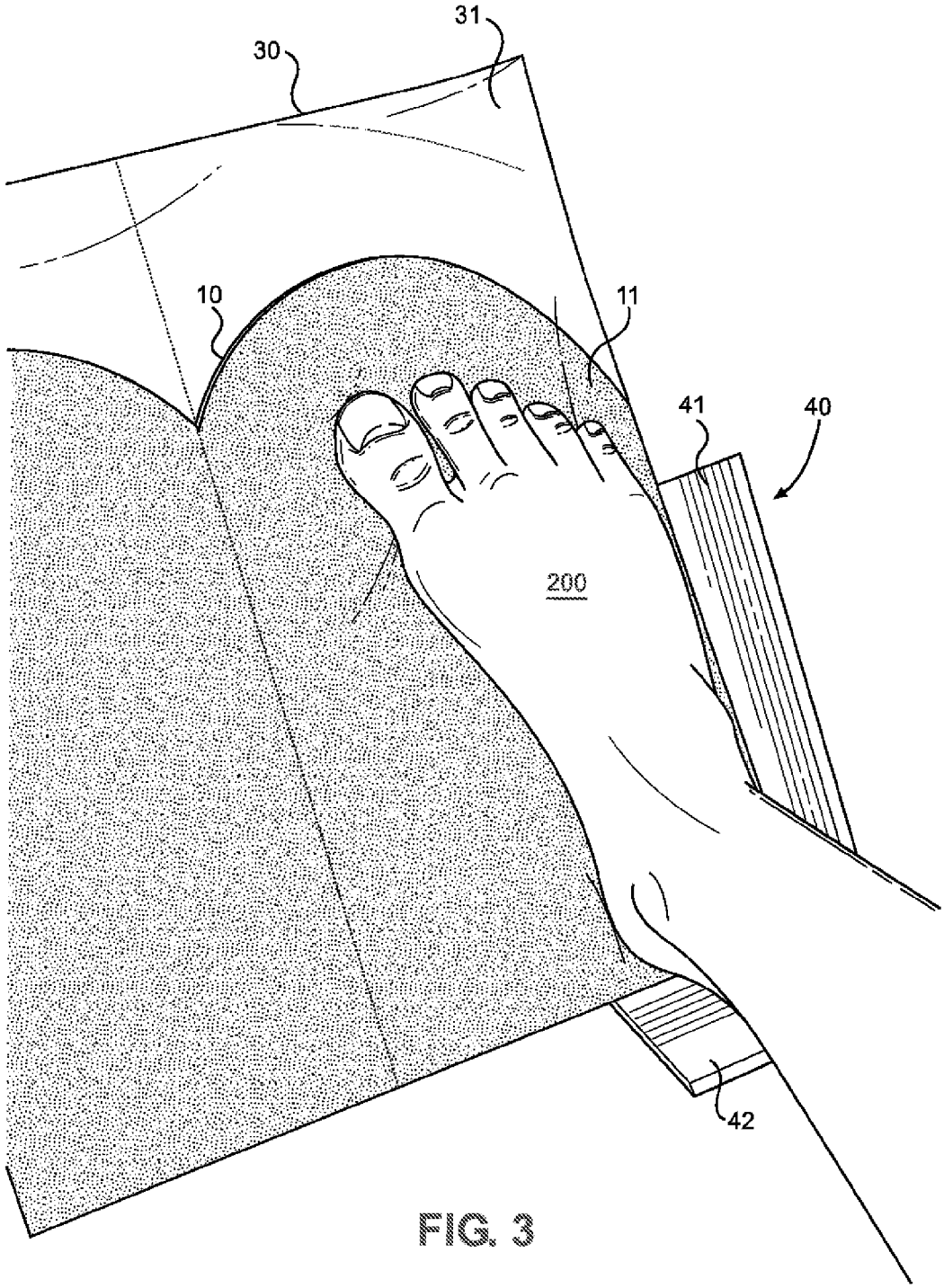
FIG. 3 depicts an overhead view the protective covering of the present invention during the process of being applied to a foot.

FIG. 3 depicts an overhead view of protective covering of the present invention during the process of being applied to a foot 200. Referring briefly to FIG. 2, release liner 20 can be peeled away from and removed from surface 11 of durable material 10. Referring back to FIG. 3, with said release liner 20 removed, surface 11 of said durable material 10 is exposed. In this position, user's foot 200 can be pressed against said surface 11 of durable material 10, allowing the underside of said foot 200 to come in contact with pressure-sensitive adhesive on surface 11. Optional alignment guide 40 having sides 41 and 42 disposed at a right angle relative to each other can also be used to assist with the placement and alignment of foot 200 relative to durable material 10.

Figure 4:
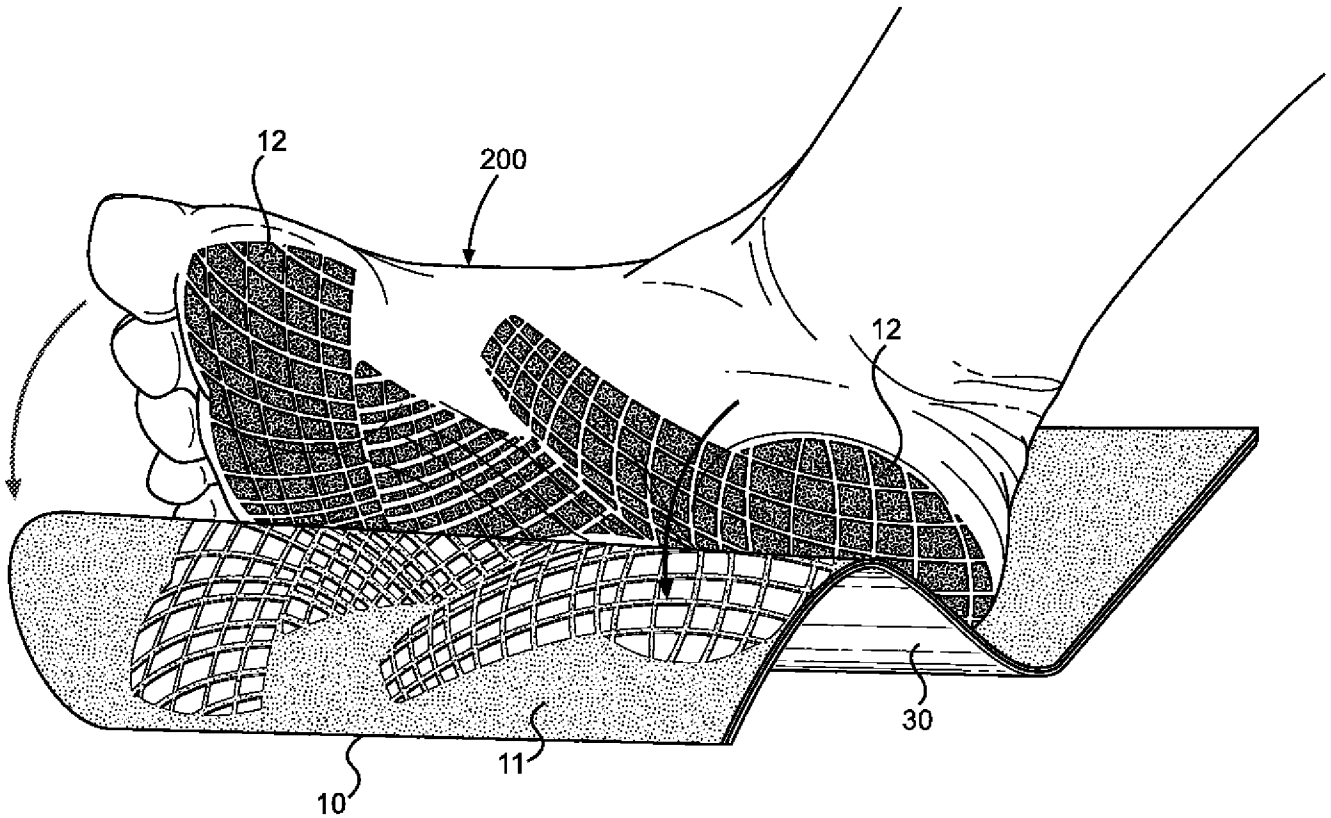
FIG. 4 depicts a side view of the protective covering of the present invention during the process of being applied to a foot.

FIG. 4 depicts a side view of the protective covering of the present invention during the process of being applied to a foot 200. After foot 200 contacts against surface 11 of durable material 10, release liner 30 can be peeled away, leaving the portion of durable material 10 contacted by foot 200 attached to the bottom surface of foot 200 (excluding the toes). In a preferred embodiment, the adhesive bond between surface 12 of durable sheet material 10 and surface 31 of release liner 30 is weaker than the adhesive bond formed between surface 11 of durable material 10 and the skin of foot 200. After durable material 10 has been applied to foot 200 in this manner, surface 12 of durable material 10 is exposed on the bottom of said foot 200.

Figure 9:
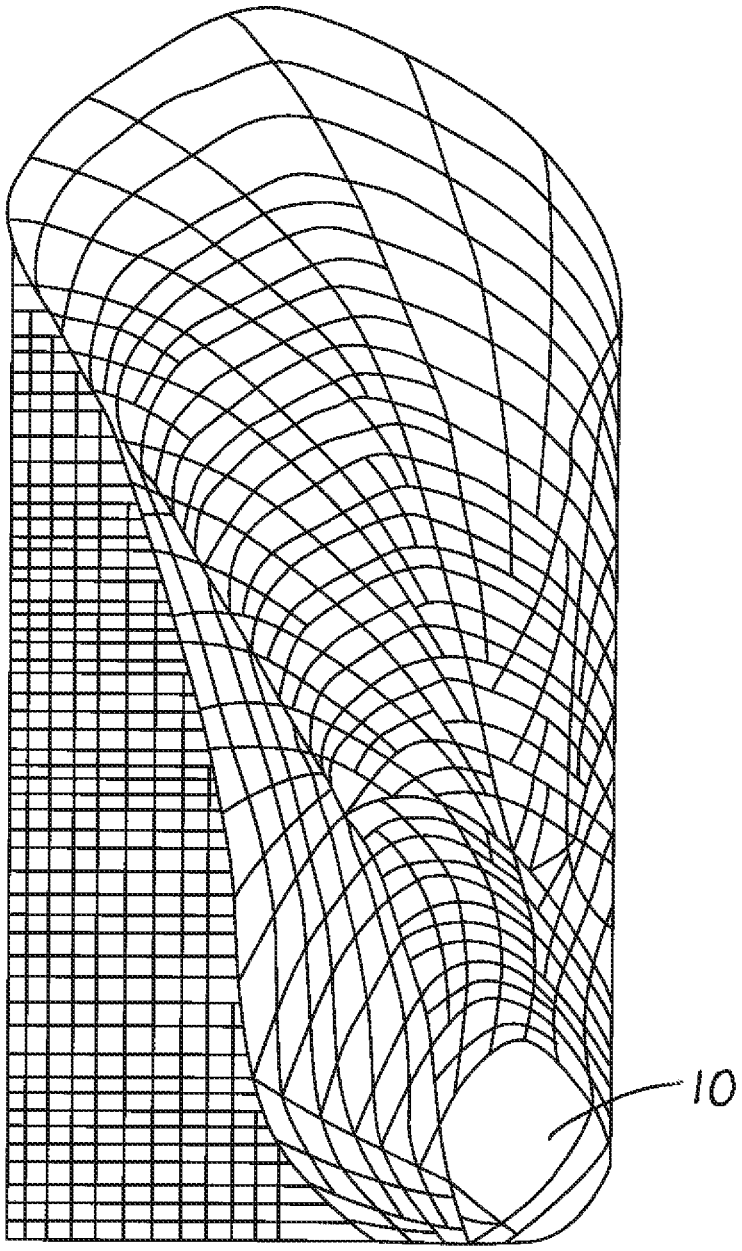
FIG. 9 depicts a preferred pre-cut pattern of the protective covering of the present invention.

FIG. 9 depicts one preferred pattern of cross-hatched pre-cuts of durable material 10 of the present invention. Said durable sheet material 10 can be beneficially pre-cut using cross-hatched pattern(s) of intersecting elongate cuts that divide said durable sheet material into a plurality of segments or pieces. Although it is to be observed that virtually any pattern can be employed, in a preferred embodiment said pattern is beneficially formed to match a specific body part or surface upon which application of said durable sheet material 10 is intended. For example, as depicted in FIG. 9, a section of durable material 10 can be pre-cut into a first plurality of segments or pieces conforming to the basic configuration of the sole of a right human foot, while another section of durable material 10 can be pre-cut into a second plurality of smaller, uniformly shaped (typically rectangular) segments or pieces.

Figure 5:
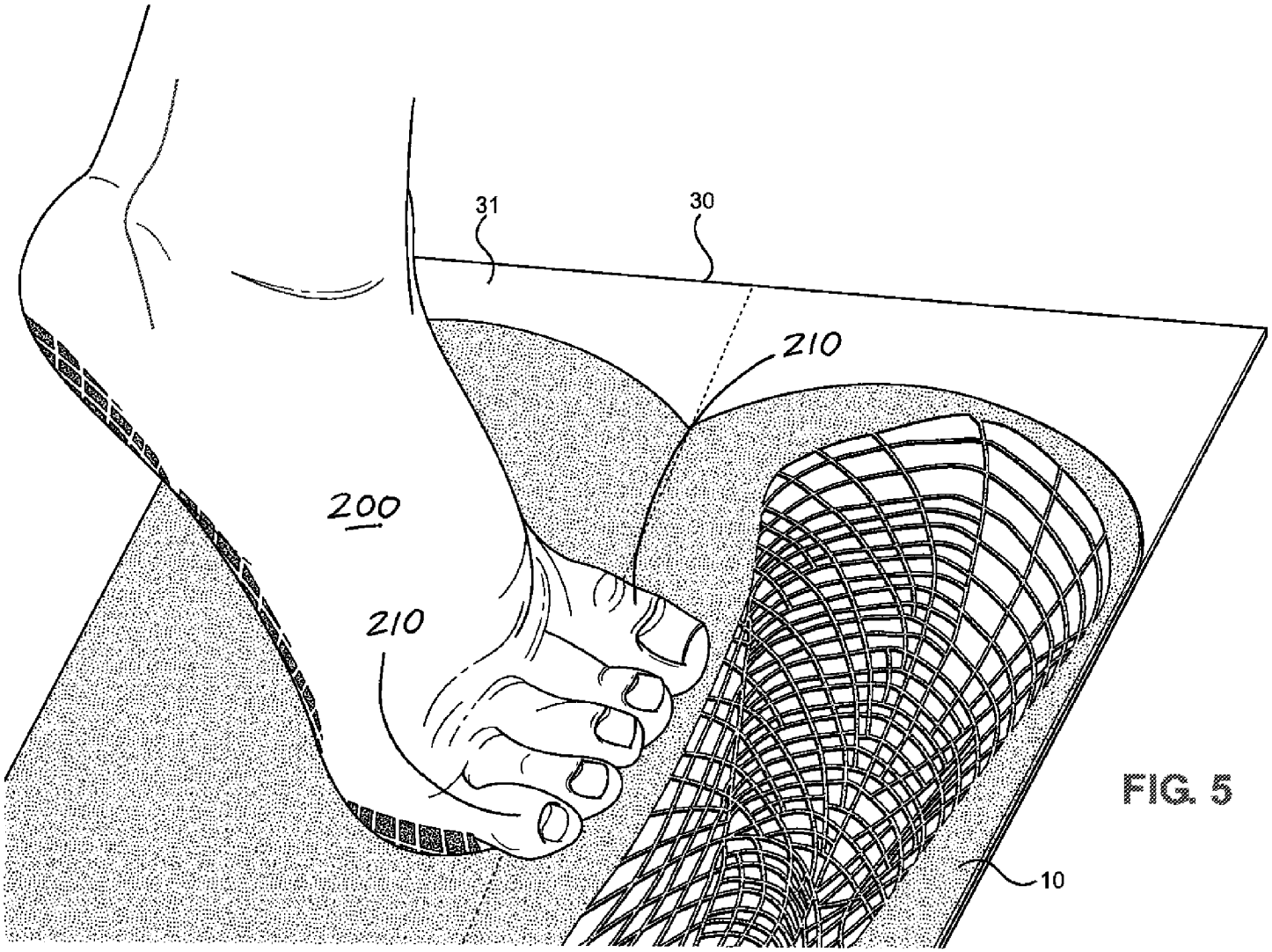
FIG. 5 depicts a side view of the protective covering of the present invention during the process of being applied to toes.

FIG. 5 depicts a side view of the protective covering of the present invention during the process of being applied to toes 210 of foot 200. According to one method of the present invention, a first plurality of pre-cut segments or pieces of durable material 10 is applied to the underside of foot 200, excluding toes 210. Thereafter, a second plurality of smaller pre-cut segments or pieces of durable material 10 is applied to the underside of said toes 210. For economy of resources, said first and second pluralities of pre-cut segments or pieces can be formed from the same sheet of durable material 10.

Figure 6:
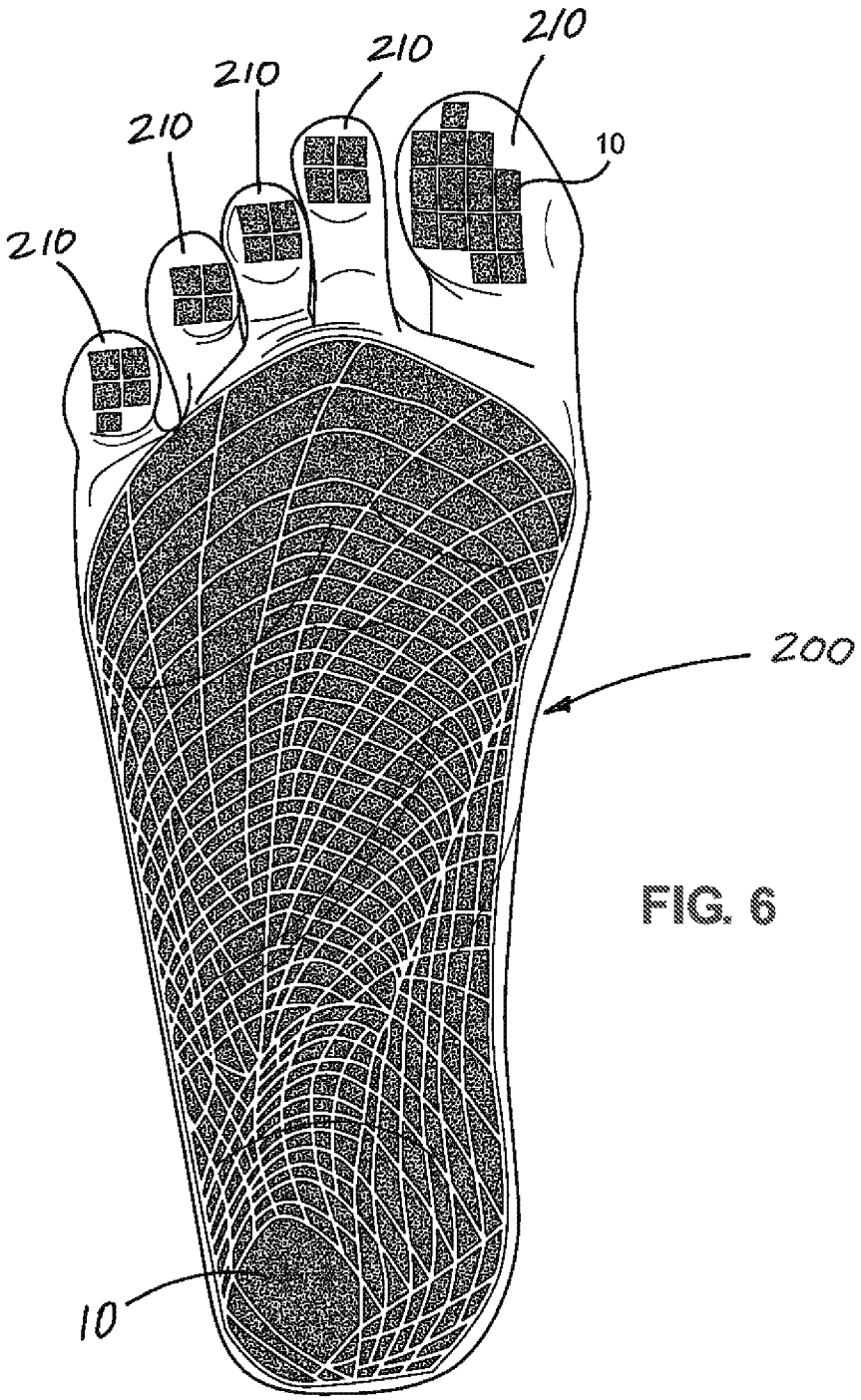
FIG. 6 depicts a plurality of segments of the protective covering of the present invention applied to the bottom of a foot.

FIG. 6 depicts a preferred pattern of cross-hatched pre-cut segments or pieces of durable material 10 of the present invention applied to the bottom of foot 200, including the bottom surface of toes 210. As depicted in FIG. 6, said durable sheet material 10 can be pre-cut using cross-hatched patterns that approximate the shape of and/or conform to the underside of human foot 200. The sizes and designs of such pre-cuts can vary. In a preferred embodiment, some or all of said pre-cuts (that is, the spaces formed between segments or pieces) have a width of at least 0.1 millimeter, so as to form a gap between adjacent segments or pieces of durable material 10 when applied to a foot 200. Said interstitial gaps permit for flexing or movement of foot 200 without side to side interference or contact of said sections or segments, which can inadvertently cause said segments or pieces to partially peel away or become detached from foot 200.

Figure 7:
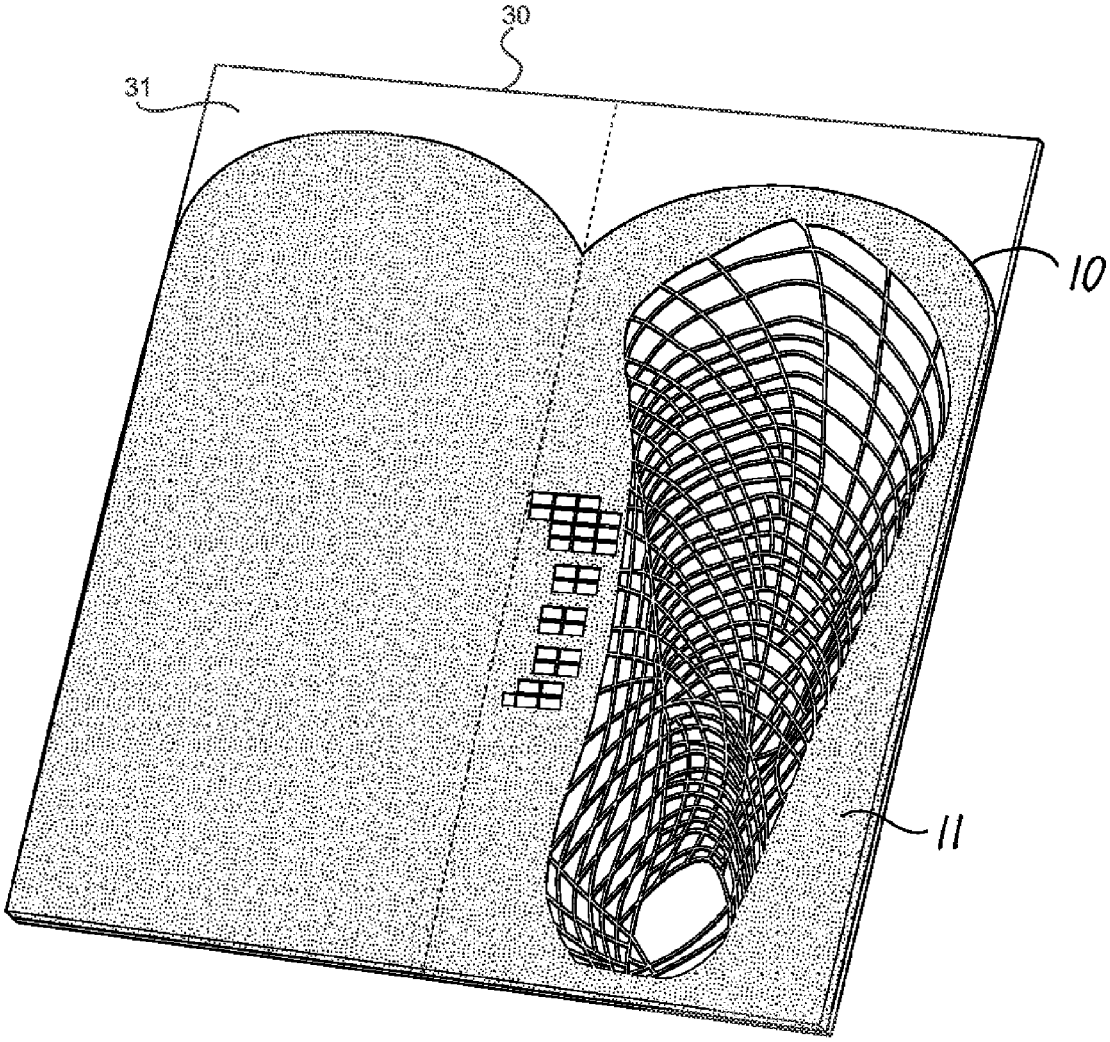
FIG. 7 depicts an overhead view of a portion of the protective covering of the present invention after a portion of said covering has been applied to a foot.

FIG. 7 depicts an overhead view of a portion of durable sheet material 10 of the present invention after said durable sheet material 10 has been applied to foot 200 depicted in FIG. 5. Those segments or pieces of durable sheet material 10 that adhere to said foot 200 are removed from surface 31 of underlying release sheet 30. By contrast, those segments or pieces of durable sheet material 10 that do not adhere to said foot 200 remain affixed to surface 31 of underlying release sheet 30.

Figure 8:
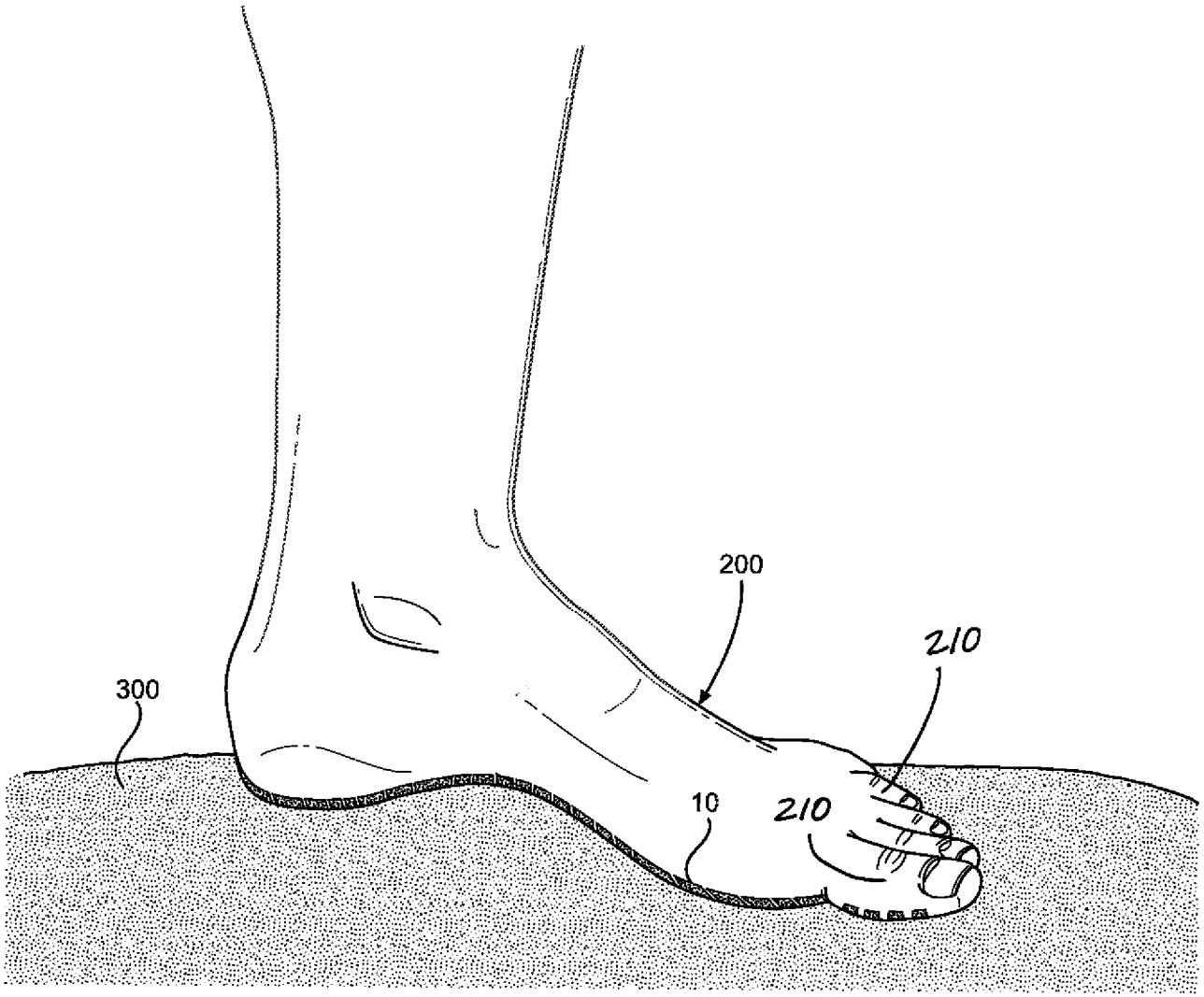
FIG. 8 depicts a side view of a foot with a protective covering of the present invention installed.

FIG. 8 depicts a side view of foot 200 (including toes 210) with durable material 10 of the present invention applied. When contact is made with a user's skin, adhesive material on surface 11 of durable material 10 should be beneficially capable of adhering to said skin, while resisting detachment resulting from contact with underlying support surfaces or the surrounding environment, such as ground 300. Said adhesive material on surface 11 of durable material 10 should be waterproof or water-resistant, non-allergenic, and should permit selective removal of said durable material from skin when desired without significant damage to or irritation of said skin.

In order to remove the protective covering of the present invention, a user can simply peel or scrape said durable material 10 from the underside of foot 200. According one optional method of removal, a sticky or adhesive material (such as, for example, duct tape) can be applied to surface 12 of durable material 10 that is exposed on the bottom of foot 200 and toes 210. When removed, said sticky or adhesive material can pull some or all of said segments or pieces of durable material 10 off of foot 200 and/or toes 210. Any remaining sections or segments of durable material 10 can then be peeled or scraped off by hand.

Application of durable material 10 to foot 200 solves problems associated with the use of conventional footwear in and around sand, mud, and water by providing a durable protective layer adhesively bonded to the bottom of foot 200. No other means of support or attachment, other than an adhesive bond, is required in order to keep said protective covering in place. Durable material 10 forms a barrier between foot 200 and the surrounding environment, keeping water, sand, and mud separated from that portion of foot 200 covered by durable material 10.

In an alternative application, durable material 10 can also be applied to the underside of a foot for the beneficial purpose of increasing traction. By way of example, but not limitation, said durable material 10 can be applied to the bottom of a foot prior to wearing high-heeled or other downwardly sloped shoes. Frictional forces existing between surface 12 of durable material 10 and an opposing insole of a shoe can help prevent a wearer's foot from sliding downward within said shoe, thereby improving comfort, function and appearance.

What is claimed:

1. A protective skin covering comprising:

a) a first release liner;

b) a second release liner;

c) a durable sheet material having a first side and a second side, said first side having a pressure-sensitive adhesive adapted to adhere to skin, wherein said first side is removably attached to said first release liner and said second side is removably attached to said second release liner.

2. The protective skin covering of claim 1, wherein said durable material comprises a plurality of pre-cut sections.

3. The protective skin covering of claim 2, wherein said plurality of pre-cut sections forms a substantially cross-hatched pattern.

4. The protective skin covering of claim 1, further comprising a traction promoting surface disposed on said second side of said durable sheet material.

5. The protective skin covering of claim 4, wherein said traction promoting surface comprises a tread.

6. The protective skin covering of claim 4, wherein said traction promoting surface comprises a non-slip material.

7. The protective skin covering of claim 1, further comprising an adhesive on said second side, wherein an adhesive bond of said first side to said skin is greater than an adhesive bond of said second side to said second release liner.

8. A protective skin covering comprising a plurality of sections of durable sheet material having a first side and a second side, wherein said first side is adapted to adhere to the underside of a foot.

9. The protective skin covering of claim 8, further comprising a pressure-sensitive adhesive disposed on said first side of said durable sheet material.

10. The protective skin covering of claim 8, further comprising a traction promoting surface disposed on said second side of said durable sheet material.

11. The protective skin covering of claim 10, wherein said traction promoting surface comprises a tread.

12. The protective skin covering of claim 10, wherein said traction promoting surface comprises a non-slip material.

13. The protective skin covering of claim 8, wherein said sections of durable sheet material are irregularly shaped.

14. The protective skin covering of claim 8, further comprising a gap between said plurality of sections wherein said gap is at least 0.1 millimeter wide.

15. A method for applying a protective skin covering comprising:

a) providing a protective skin covering, said protective skin covering comprising:

i) a first release liner;

ii) a second release liner;

iii) a durable sheet material having a first side and a second side, said first side having a pressure-sensitive adhesive adapted to adhere to skin, wherein said first side is removably attached to said first release liner and said second side is removably attached to said second release liner;

b) removing said first release liner from said durable sheet material;

c) contacting the underside of a foot against said first side of said durable sheet material;

d) adhering said durable sheet material to said foot; and e) moving said second release liner away from said foot, wherein a portion of said durable sheet material remains adhered to said foot.

16. The method of claim 15, wherein said durable material comprises a plurality of pre-cut sections.

17. The method of claim 16, wherein said plurality of pre-cut sections forms a substantially cross-hatched pattern.

18. The method of claim 15, further comprising a traction promoting surface disposed on said second side of said durable sheet material.

19. The method of claim 18, wherein said traction promoting surface comprises a tread.

20. The method of claim 18, wherein said traction promoting surface comprises a non-slip material.

* * * * *